United States Patent [19]

Geleziunas

[11] Patent Number: 4,832,271

[45] Date of Patent: May 23, 1989

[54] DISPENSER FOR ROLL OF MATERIAL

[76] Inventor: Rimas J. Geleziunas, 3900 Yonge Street, Toronto, Ontario, Canada, M4N 3N6

[21] Appl. No.: 49,374

[22] Filed: May 14, 1987

[51] Int. Cl.[4] ..... B65D 85/67

[52] U.S. Cl. ..... 242/55.53; 206/408

[58] Field of Search ..... 206/408; 242/55.53

[56] References Cited

U.S. PATENT DOCUMENTS

| | | | |
|---|---|---|---|
| 2,861,753 | 11/1958 | Sipior | 206/408 X |
| 3,190,520 | 6/1965 | Wyant | 242/55.53 |
| 3,918,661 | 11/1975 | Kishi et al. | 242/55.53 |
| 4,659,028 | 4/1987 | Wren | 206/408 X |

*Primary Examiner*—William Price

*Attorney, Agent, or Firm*—Rogers, Bereskin & Parr

[57] ABSTRACT

A dispenser is provided having a chamber for a roll of material, for example a roll of paper towels. It has a base, a front wall and a slot in the base adjacent to the front wall for the free end of a roll of material. A control member is pivotally mounted to the body above the slot within the chamber. It has a control surface, which, in use, abuts a roll of material to maintain the roll of material adjacent to the front wall and slot. This enables a user to pull out the roll and tear off single sheets, by a single handed operation. The control member provides the necessary friction, while enabling the roll of material to be unwound. The dispenser can have a catch assembly for a door, which includes first and second part recesses. The first part recess has a vertical locking face. A catch can engage this locking face. The catch can also be displaced into the second part recess, to enable it to be disengaged. The recess and the catch are displaceable away from one another to enable the catch to ride out of the second part recess over an inclined face.

21 Claims, 4 Drawing Sheets

DISPENSER FOR ROLL OF MATERIAL

FIELD OF THE INVENTION

T to a dispenser for a roll of material, and this invention more particularly relates to a dispenser for a roll of paper towels, which are partially separated by perforations.

BACKGROUND OF THE INVENTION

At the present time, it is common in kitchens and elsewhere, to provide a roll of paper towels, for various uses. The paper towels can be used for numerous purposes, where it is desired to clean surfaces, or mop up liquids. Many dispensers or holders for paper towels have been proposed. A common design is intended for mounting on a flat surface, usually the underside of a cabinet, and includes two arms. The arms include cylindrical bearing surfaces extending towards one another, on which a roll of paper towels is mounted. The roll of paper towels includes a central, cardboard tube, that engages the bearing surfaces. To engage the roll with the bearing surfaces, the bearing surfaces have to be sprung apart. This action can be awkward. Further, if a certain degree of care is not exercised, then the ends of the cardboard tube become damaged, making it difficult to engage the bearing surfaces. Further, this design requires the arms to be spring-loaded, and in some cases the arms can be relatively easily damaged.

In use, a user unwinds the roll by pulling a free end of the roll. The individual paper towels are initially partially separated by perforations. To detach an individual towel, it has to be torn from the roll. The spring arms are intended to grip the roll sufficiently, to enable each sheet to be torn off. However, in many cases the grip is insufficient, so that the roll of towels has to be held steady with the other hand, whilst one towel is torn off. Also, the spring action of the arms makes no allowance for the varying diameter of the roll as the towels are used up.

Accordingly, it is desirable to provide a dispenser for a roll of paper towels or the like, which enables the roll to be quickly and easily mounted in it. Preferably, the roll should be mounted, without requiring the engagement of any bearing elements in its central tube. The dispenser should also enable each individual towel to be torn off simply by a one-handed operation, and this should be easily accomplished, for all sizes of roll. It is also desirable that a dispenser should have a clean, asthetic appearance, and protect the roll of towels from accidental damage or soiling.

BRIEF SUMMARY OF THE INVENTION

In accordance with the present invention, there is provided a dispenser comprising a body defining a chamber for a roll of material and having a base, a front wall and a slot in the base adjacent to the front wall for the free end of a roll of material, and a control member in the chamber and pivotally mounted to the body above the slot and having a control surface which, in use, abuts a roll of material to maintain the roll of material adjacent to the front wall and slot.

Preferably, the slot is provided between the base, and a door member, that is pivotally attached to the body adjacent to the front thereof. The door member preferably includes an inclined portion, to maintain the roll of material in the correct position. The control member is preferably pivotally attached to the body adjacent to the pivotal attachment of the door member, and the control surface is planar. Then, as the size of a roll of material diminishes, the angle of the control surface to the vertical increases, which ensures that the necessary force is applied to the roll at all times, as detailed below.

The dispenser of the present invention enables individual paper towels to be torn off a roll of paper towels readily. The dispenser can be arranged to be secured to a wall or other vertical surface. Then, each individual towel is simply removed by grasping it and pulling it upwards and sideways. The friction between the remainder of the roll of material and the various components of the dispenser prevent it unrolling, as the towel is torn off. Since no axle or shaft is provided for the roll, loading the dispenser with a roll of material is quick and simple.

In accordance with another aspect of the present invention, there is provided a catch assembly comprising a locking catch for movement in one direction, and mounted for deflection in a second, generally perpendicular direction; and a locking recess provided in a wall portion and comprising a first part recess including a locking face extending generally perpendicularly to the first direction for engaging the locking catch, and a second part recess continuous with the first part recess and spaced therefrom in the second direction and including an inclined face permitting the locking catch to ride over the inclined face out of the recess, after the locking catch has been deflected from the first part recess into the second part recess in said second direction, the locking catch and the locking recess being resiliently deflectable away from one another in a third direction, generally perpendicular to the first and second directions, to enable the locking catch to ride over the inclined face.

This catch assembly can be incorporated into the dispenser defined above. Thus, on either side of the door member, there can be provided two locking catches, with corresponding locking recesses in end walls of the dispenser. The locking catches are provided on extensions separate from the main body of the door member, to enable them to be deflected resiliently in the second direction. To close the dispenser, the locking catches can ride over the end walls, which reflect resiliently, to enable the locking catches to be received in the first part recesses. To open the dispenser, the locking catches are deflected in the second direction, to bring them into the second part recesses. The door can then be opened. The locking catches ride over the inclined faces, and the end walls deflect outwards, to permit the door member to open.

BRIEF DESCRIPTION OF THE SEVERAL VIEWS OF THE DRAWING

For a better understanding of the present invention, and to show clearly how it may be carried into effect, reference will now be made, by way of example, to the accompanying drawings, which show a preferred embodiment of the present invention, and in which.

Figure 1:
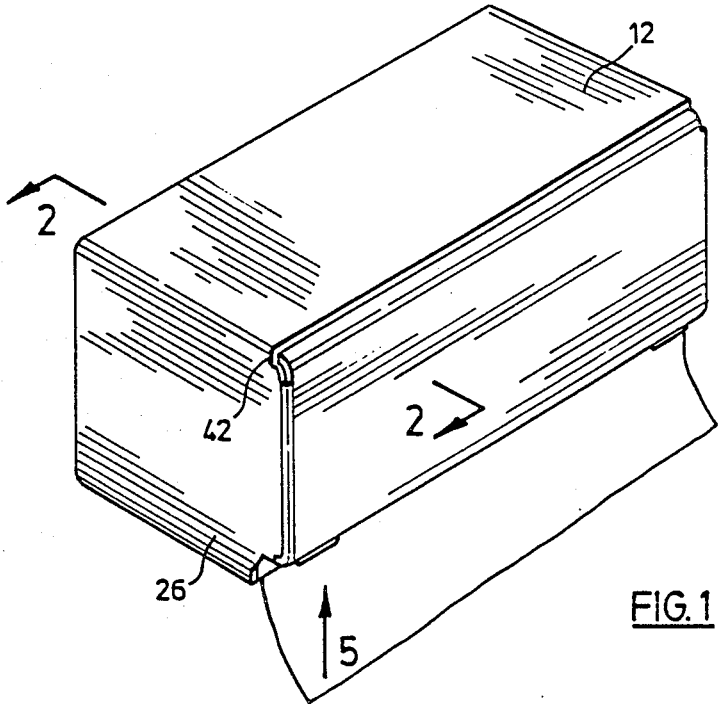
FIG. 1 is a perspective view of a dispener in accordance with the present invention.
Figure 2:
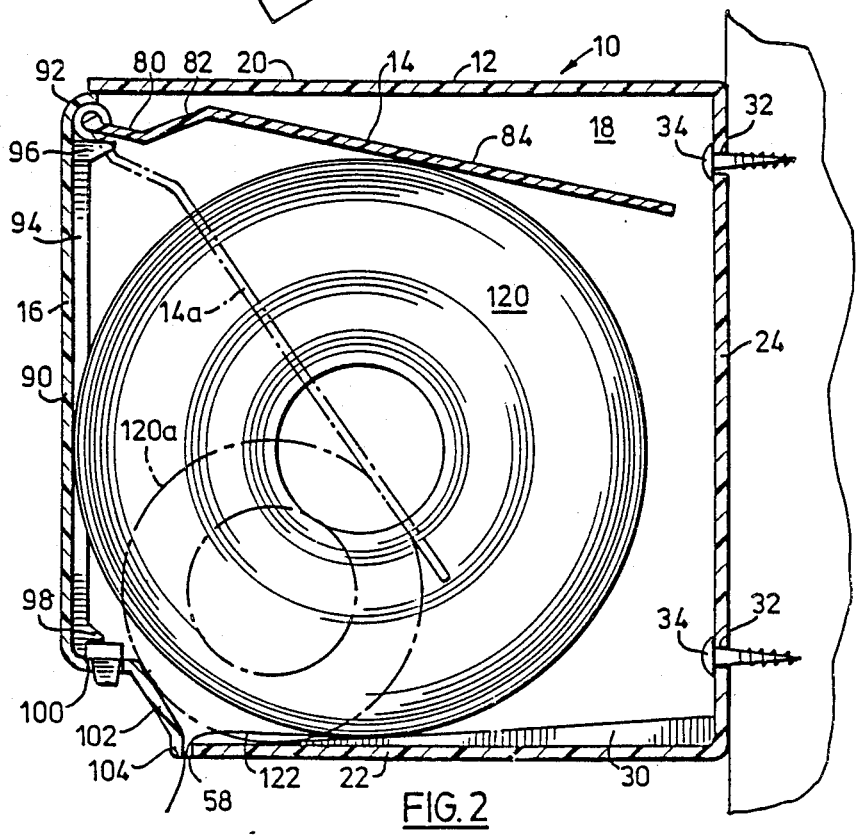
FIG. 2 is a cross-section along line 2—2 of FIG. 1, on a larger scale.
Figure 3:
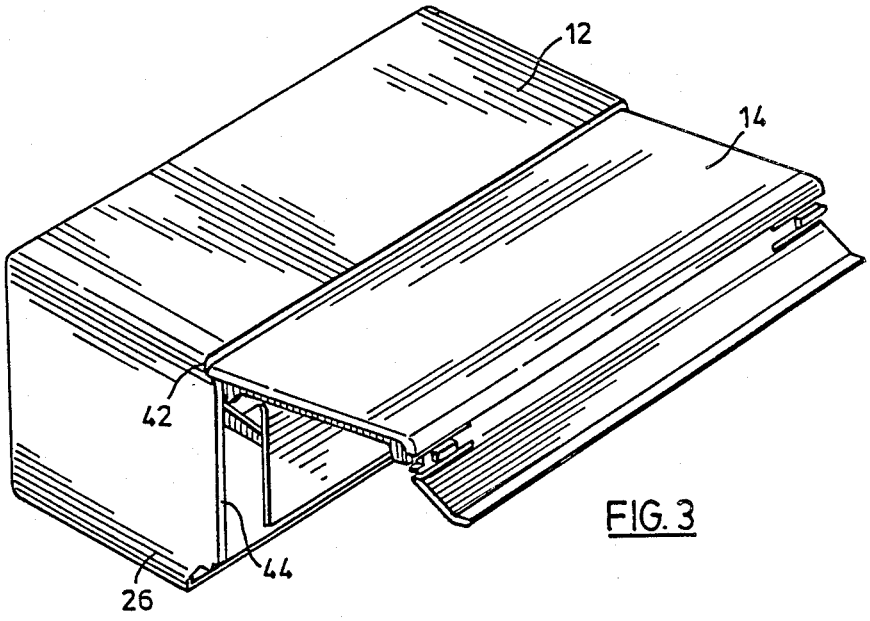
FIG. 3 is a perspective view of the dispenser of FIGS. 1 and 2, in an open configuration.

Referring first to FIGS. 1, 2 and 3, the dispenser is generally indicated by the reference 10. The dispenser 10 comprises a body 12, a door member 16, and a control member 14. As detailed below, the control member 14, and the door member 16 are pivotally mounted to the body 12, which defines a chamber 18.

The body 12 has generally rectangular walls. The body 12 has top and bottom walls 20, 22. A rear wall 24 extends between the top and bottom walls 20, 22. End walls 26, 28 are similarly continuous with the top, bottom and rear walls 20, 22, 24. The bottom wall 22 includes two ribs 30, whose top edges are inclined towards the front of the body 12. Each rib 30 is spaced approximately one third of the way along the bottom wall 22.

The rear wall 24 includes openings 32. As shown, screws 34 can be inserted in these openings 32, to mount the dispenser 10 to a wall or other vertical surface.

The end walls 26, 28 include respective pivot projections 36, directed towards one another, the end walls 26, 28 being generally symmetrical. Each pivot projection 36 includes a first, cylindrical pivot surface 37 around its outside and a second, cylindrical pivot surface 38 on its inside. The pivot projections 36 are located adjacent to the front edges 40 of the end walls 26, 28.

Figure 6C:
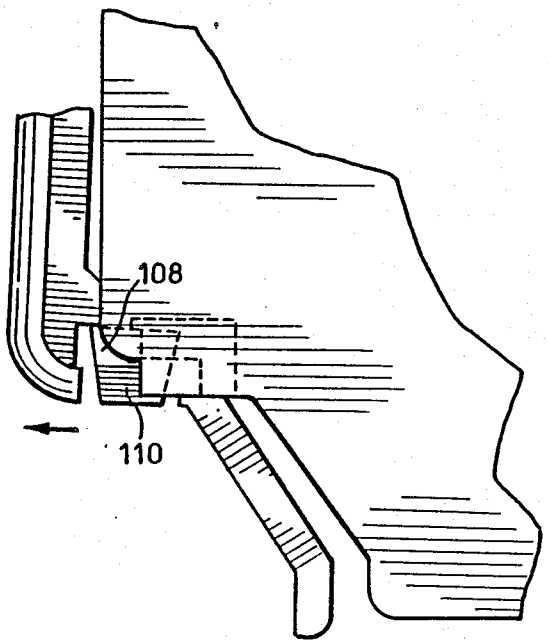
FIGS. 6*a*, 6*b* and 6*c* are side views of the other end of the dispenser, showing operation of the catch assembly.
Figure 6B:
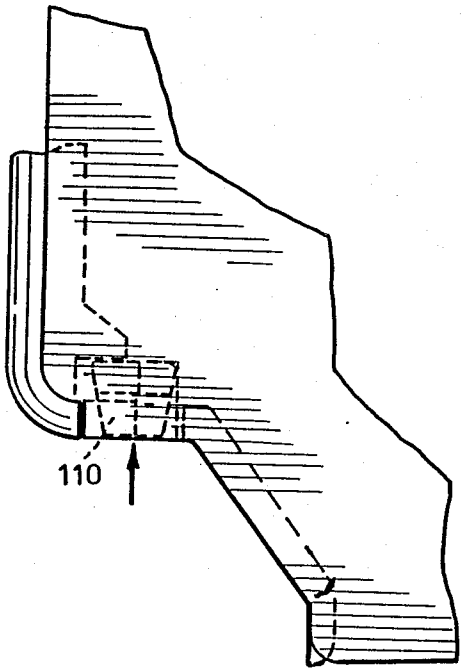
Figure 6A:
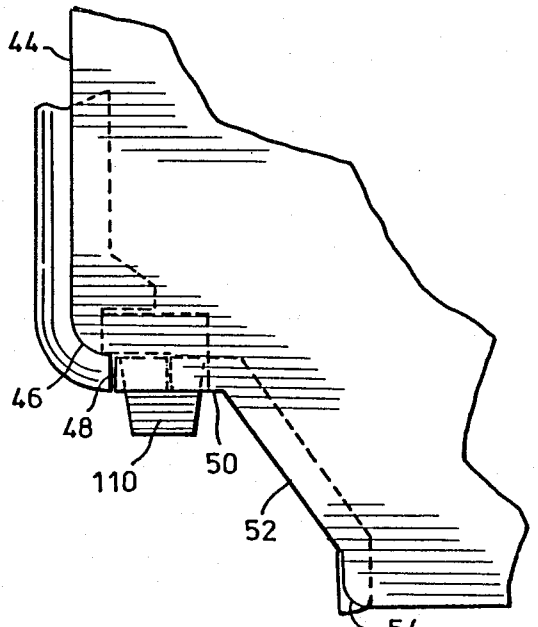

The front edges 40 are shaped to correspond to the door member 16. As shown in FIG. 1, for the end wall 26, the upper part of the front edge 40 is a vertical uppermost portion 42. This then continues through a quadrant that is continuous with the cylindrical pivot surface 37 into a main, intermediate portion 44. This intermediate portion 44 is vertical and forms the major part of the front edge 40. FIGS. 6*a*–6*c* show the lower profile of the front edge 40,for the other end wall 28. Here, it can be seen that the intermediate portion 44 continues into a lower quadrant 46. Extending from this lower quadrant 46 is a short, vertical part 48, and extending back from this is a horizontal portion 50. An inclined portion 52 extends from the end of the horizontal portion 50, and a bottom quadrant 54 is continuous with the inclined portion 50.

Towards the bottom of each end wall 26, 28 and at the front thereof, there is a locking recess 60. The locking recess 60 is most clearly shown in FIG. 4*b* for the end wall 26. The locking recess 60 includes a first part recess 62 and a second part recess 64. The first part recess 62 is terminated at the front by a vertical locking face 66. At the rear, the part recesses 62, 64 have a common curved or bevelled end surface 68. This rear end surface 68 is intended to correspond to the profile of a locking catch, as detailed below. At the front of the second part recess 64, there is an inclined face 70.

Figure 4A:
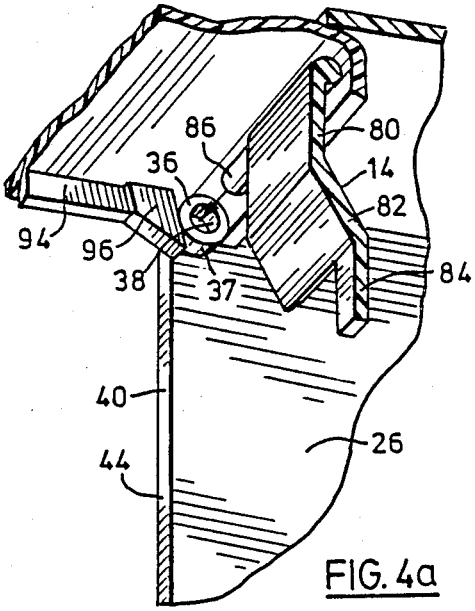
FIGS. 4*a* and 4*b* are perspective views of a pivot assembly and part of a catch assembly of the dispenser.
Figure 4B:
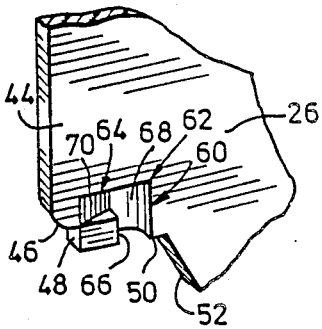

The baffle member 14, as shown in FIGS. 2 and 4*a*, has an elongate, rectangular upper strip 80, which is continuous with a rectangular, inclined part 82. Continuous with the inclined part 82 is a rectangular and planar control part 84. The upper strip 80 and rectangular part 82 extend to the width of the body 12, whilst, as shown in FIG. 4*a*, the control part 84 is stepped in at either side. Again, the control member 14 is generally symmetrical. At either end of the upper strip 80, there are pivot pins 86. The inclined part 82 is such as to step the control part 84 away from the pivot pins 86. This is such that, when rotated upwards, the control part 84 can be brought into abutment with the top wall 20 of the body 12. The pivot pins 86 are engaged with the second pivot surface 38, as indicated in FIG. 4. The control member 14 is free to pivot, and is not subjected to any spring biasing force.

The door member 16 has a main planar panel 90. At the top, the panel 90 continues into an arcuate section 92. As shown in FIG. 1, the arcuate section is stepped in at each end by an amount equal to the thickness of the end walls 28. This enables the arcuate section 92 to rotate into the body 12. The vertical edges of the main panel 90 are rounded, as shown. As shown in FIGS. 1 and 3, extending down either edge of the main panel 90 is a rib 94. At the upper end of each rib 94, there is an extension 96, of greater thickness than the main part of the rib 94. The extension 96 and the arcuate section 92 are shaped to engage the first cylindrical pivot surface 37, add engage it through an angle greater than 180 degrees. This enables the door member 16 to be clipped to the pivot projections 36. At the lower end of each rib 94, there is a lower extension 98. The ribs 94 are shaped to fit within the end wells 26, 28.

The main planar panel 90 of the door member 16 continues at its lower edge into horizontal section 100. This horizontal section similarly continues into an inclined section 102 and a lowermost vertical section 104.

Figure 5A:
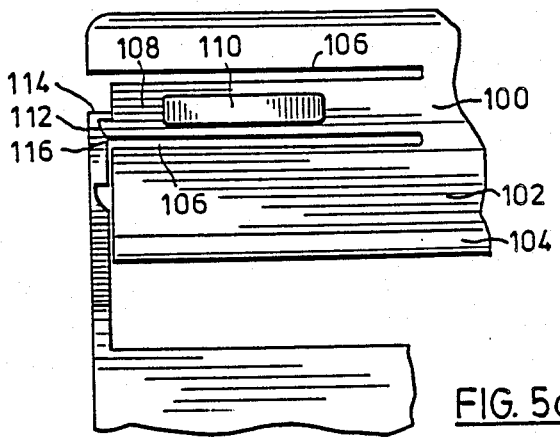
FIGS. 5*a*, 5*b* and 5*c* are bottom views of one end of the dispenser, showing operation of a catch assembly.
Figure 5B:
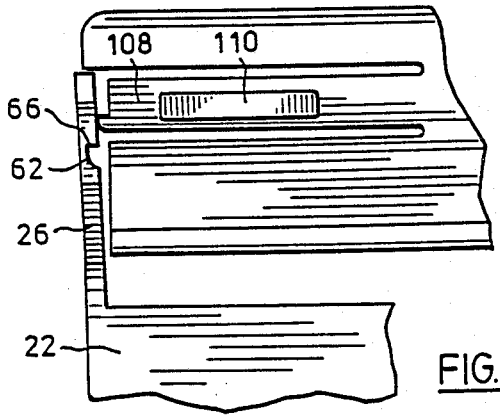
Figure 5C:
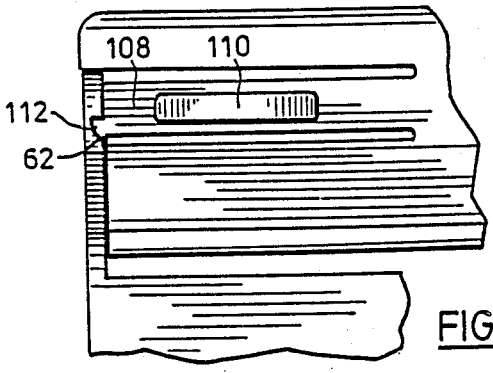

As best shown in FIGS. 5*a*, 5*b* and 5*c*, at each end of the horizontal section 100, there are two parallel slots 106. These slots 106 separate an arm 108 from the main part of the horizontal section 100.

Each arm 108 is slightly thicker than the horizontal section 100. The arm 108 includes a protrusion 110, for a user's finger or thumb. At the free end of the arm 108, there is a locking catch 112. As shown, the locking catch 112 includes a locking face 114, that is vertical in the closed configuration, and a bevelled or rounded face 116. Each locking catch 112 and its locking recess 60 forms a catch assembly.

In use, the various components of the dispenser 10 are assembled as shown. Thus, the control member 14 is pivotally engaged in the second cylindrical pivot surfaces. As the control member 14 is generally planar, this is achieved by bending it, to move the pivot pins 86 together. The door member 16 is clipped to the outside of the pivot projections 36. A roll of paper towels, indicated at 120 is then placed within the dispenser 10. Whilst the roll 120 can be placed with its free end extending from either side, it is shown in FIG. 2 with a free end 122 extending from the bottom of the roll. The roll 120 then rests on the ribs 30. With the roll 120 in position, the control member 14 is displaced to the configuration shown in FIG. 2, resting on top of the roll.

The door member 16 is then closed, by simply pressing it into position. FIGS. 5*a*–5*c* show the closure sequence. As the door member 16 is closed, the locking catches 112 come up against the vertical parts 48 of the front edges 40 (FIG. 5*a*). The bevelled faces 116 then displace the end walls 26, 28 resiliently outwards, enabling the locking catches 112 to slide into the chamber 18 (FIG. 5*b*). When the door member 16 is pressed down, the locking catches 112 enter the part recesses 62 (FIG. 5*c*), and the end walls 26, 28 spring back into their normal positions. The corresponding locking faces 66, 114 of the first part recess 62 and the locking catch 112 then engage one another, to secure the door member 16 in position.

In this position, the bottom wall 22 and the door member 16 define a slot 58, through which the free end 122 of the roll 120 extends. The lowermost vertical section 104 of the door member 16 has a rounded edge to enable paper towels to pass over it freely. The dispenser 10 is then ready for use.

As shown in FIG. 2, with a full roll 120, the roll contacts the main planar panel 90 of the door member 16, and the ribs 30 extending out from the bottom wall 22. The control member 14 rests on top of the roll 120, to apply a gentle pressure locating it in position, and urging it slightly forward. To remove a paper towel, the free end 122 is pulled out, until the row of perforations separating the end towel from then next towel are visible. The end towel is then grasped and pulled sideways and upwards, tearing it from the next towel. The next towel then becomes the free end 122, and can be pulled out, repeating the sequence. It has been found that the configuration of the various elements retains the roll 120 in the correct position whilst enabling the free end 122 to be readily withdrawn. Further, there is sufficient friction in the arrangement that a single towel can be torn off simply with a single-handed motion; there is little or no tendency for the roll to unwind when a towel is torn off.

As the roll 120 diminishes in size, it will eventually contact the inclined section 102 of the door member 16. Such a reduced roll is indicated at 120*a*. This reduced roll 120*a* then rests against the inclined section 102 and either the bottom wall 22 or the ribs 30. The configuration of the inclined section 102 has been found to be important. If the angle of the inclined section to the horizontal is too small, then the roll has a tendency to climb up it, which is undesirable. On the other hand, if the inclined section 102 is too steep, then there is a tendency for the roll 120*a* to become jammed. It should be borne in mind that paper towels are usually relatively loosely wound. Accordingly, if there is too much pressure on any part of the roll, as it unwinds, the layers of towel on the roll tend to build up ahead of the pressure location. As shown in FIG. 2, for the reduced roll 120*a*, the control member 14 has pivoted down to a position 14*a*. In this position, as the control member 14 is nearer the vertical, there is a reduced force on the roll 120*a* due to the weight of the control member 14. Further, as the control member 14 is in the position 14*a*, with the roll 120*a* abutting near the end of the control member 14, this also reduces the load applied to the roll 120. A great part of this force is applied urging the roll 120*a* against the inclined section 102, with a smaller part applied downwards. This serves to provide the necessary loads on the roll 120*a*.

Consequently, for the whole of a roll 120, paper towels can be unwound and torn off single-handedly.

To open the dispenser 10 to replace a roll, the catch assembly is operated as shown in FIGS. 6*a*–6*c*. The protrusions 110 are pressed upwards. Conveniently, this is done by placing the fingers on the end walls 26, 28 and then pressing the protrusions 110 upwards with the thumb. This displaces the locking catches 112 out of the first part recesses 62 into the second part recesses 64, as shown in FIG. 6*b*. The locking faces 66, 114 are then disengaged from one another. With the thumbs held on the protrusions 110, the door member 16 is swung open. The locking catches 112 then ride over the inclined faces 70 of the second part recesses 64. This again displaces the end walls 26, 28 outwards (FIG. 6*c*). When the locking catches 112 disengage from the end walls 26, 28, the protrusions 110 can be released. The door member 16 can then be swung fully open. The cardboard tube left from the last roll of towels 120 can then be removed, and replaced with a fresh, full roll. The door member 16 is then closed, as described above, and the dispenser 10 is then ready for use again.

All the components of the dispenser 10 could be moulded in a hard ABS plastic.

I claim:

1. A dispenser comprising a body defining a chamber for a roll of material and having a bottom wall, a front wall and a slot end at the bottom wall adjacent the front wall for the free end of a roll of material, and a control member in the body and pivotally mounted to the body above the slot and having a control surface which, in use, abuts a roll of material to maintain the roll of material adjacent the front wall and the slot.

2. A dispenser as claimed in claim 1, wherein the slot is spaced rearwardly back from the front wall.

3. A dispenser as claimed in claim 2, which includes an inclined section extending downwardly and rearwardly from the front wall, against which inclined section a roll of material can abut in use, with the slot defined between the inclined section and the bottom wall.

4. A dispenser as claimed in claim 3, wherein the control member includes a planar control part defining a planar control surface.

5. A dispenser as claimed in claim 4, wherein the control member is pivotally mounted about a pivot axis, which is stepped away from a plane containing the planar control surface.

6. A dispenser as claimed in claim 2, 3 or 5, which includes a door member, which door member includes the front wall and the inclined section, and which is pivotally mounted to the body above the slot adjacent the front thereof.

7. A dispenser as claimed in claim 4, which includes a door member, which includes the front wall and the inclined section and which door member is pivotally mounted to the body above the slot adjacent the front thereof.

8. A dispenser as claimed in claim 7, wherein the body includes end walls extending upwardly from the bottom wall and a pivot projection on each end wall extending inwardly towards the pivot projection of the other end wall, the pivot projections defining first, external pivot surfaces, and wherein the door member includes an arcuate section at the upper edge thereof continuous with the front wall and curving rearwardly, and on either side upper extensions extending rearwardly adjacent to the arcuate section, whereby the arcuate section and the upper extensions pivotally engage the first cylindrical pivot surfaces of the pivot projections.

9. A dispenser as claimed in claim 8, wherein the door member includes, on the rear thereof, ribs which extend vertically and rearwardly from the upper extensions, and lower extensions extending rearwardly from the lower ends of the ribs, the ribs and lower extensions being arranged to abut the end walls.

10. A dispenser as claimed in claim 9, wherein the door member includes a horizontal section, which extends rearwardly from the front wall thereof, to the inclined section, and a lowermost vertical section extending down from the inclined section, which lowermost vertical section includes a rounded edge against which material bears in use.

11. A dispenser as claimed in 10, wherein the control member is pivotally mounted to the pivot projections about a pivot axis and the planar control part of the control member is stepped upwardly and rearwardly away from the pivot axis.

12. A dispenser as claimed in claim 11, wherein the body includes a planar, generally horizontal top wall, and wherein the planar control part of the control member is stepped away from said axis by an amount such that it can be brought into abutment parallel with the top wall.

13. A dispenser as claimed in claim 12, wherein the control member comprises an elongate, generally rectangular upper strip, a rectangular inclined part extending at an obtuse angle to the upper strip, and said planar control part extending from the inclined part generally parallel to the upper strip.

14. A dispenser as claimed in claim 8 or 13, wherein the pivot projections include second, internal pivot surfaces wherein the control member includes, at either end at an upper edge thereof, pivot pins, which engage the second cylindrical pivot surfaces, and wherein the pivot projections include second, internal cylindrical pivot surfaces.

15. A dispenser as claimed in claim 7, wherein the door member includes at either side thereof a catch assembly for securing the door member to the end walls.

16. A dispenser as claimed in claim 15, wherein each catch assembly comprises a locking catch extending out from the door member, and mounted for resilient deflection towards a pivot axis of the door member; a locking recess provided in the corresponding end wall and comprising a first part recess including a locking face extending generally vertically, for engaging the locking catch, and a second part recess continuous with the first part recess and spaced vertically therefrom and including an inclined face permitting the locking catch to ride over the inclined face out of the recess, after the locking catch has been deflected from the first part recess into the second part recess in a vertical direction, the end walls being resiliently deflectable away from the locking catches, to enable the locking catches to ride over the inclined faces.

17. A dispenser as claimed in claim 16, wherein, for each catch assembly, the first and second part recesses have a common, curved rear end wall.

18. A dispenser as claimed in claim 16 or 17, wherein the locking catch of each catch assembly has a locking face that abuts the locking face of the corresponding recess, and a bevelled face enabling the locking catch to resiliently displace the corresponding end wall sideways.

19. A dispenser as claimed in claim 10, wherein the door member includes at either side thereof a catch assembly for securing the door member in position, each catch assembly comprising a locking catch extending outwardly from the horizontal section and arranged for resilient deflection in a direction perpendicular to the horizontal section; a locking recess provided in a corresponding end wall and comprising a first part recess including a locking face extending generally vertically for engaging the locking catch, and a second part recess continuous with the first part recess and spaced vertically therefrom and including an inclined, face permitting the locking catch to ride over the inclined face out of the first part recess, after the locking catch has been deflected from the first part recess into the second part recess in the direction perpendicular to the horizontal section, the end walls being resiliently deflectable away from one another to enable the locking catches to ride over the inclined faces.

20. A dispenser as claimed in claim 19, wherein at either end of the horizontal section, there are arms, each arm extending towards its respective end wall and including a respective locking catch at the free end thereof, the arms permitting the deflection of the locking catches in the direction perpendicular to the horizontal section.

21. A dispenser as claimed in claim 20, in which the arms include protrusions, for operation by a user.

* * * * *